United States Patent [19]

Ueda et al.

[11] Patent Number: 4,735,071

[45] Date of Patent: Apr. 5, 1988

[54] APPARATUS FOR CONTINUOUSLY PRODUCING TUBE HAVING HELICAL GROOVES IN ITS INNER SURFACE

[75] Inventors: Iwao Ueda, Izumi; Minobu Sukimoto, Sakai, both of Japan

[73] Assignees: Hamana Iron Works Co., Ltd.; Showa Aluminum Corporation, both of Osaka, Japan

[21] Appl. No.: 36,533

[22] Filed: Apr. 9, 1987

[30] Foreign Application Priority Data

Apr. 10, 1986 [JP] Japan ..... 61-83387

[51] Int. Cl.[4] ..... B21B 15/02; B21D 11/14

[52] U.S. Cl. ..... 72/65; 29/157.3 AH; 72/299; 72/371

[58] Field of Search ..... 72/64, 65, 68, 77, 299, 72/371, 367; 57/138; 29/157.3 AH

[56] References Cited

U.S. PATENT DOCUMENTS

| | | | |
|---|---|---|---|
| 1,887,837 | 11/1932 | Frank | 57/138 |
| 1,951,687 | 3/1934 | Zapf | 57/138 |
| 2,503,987 | 4/1950 | Anderson | 57/138 |
| 3,422,518 | 1/1969 | French | 72/209 |
| 3,662,582 | 5/1972 | French | 72/367 |
| 3,776,018 | 12/1973 | French | 72/367 |
| 3,961,514 | 6/1976 | Geary | 72/64 |

*Primary Examiner*—Robert L. Spruill
*Assistant Examiner*—Donald R. Studebaker
*Attorney, Agent, or Firm*—Armstrong, Nikaido, Marmelstein & Kubovcik

[57] ABSTRACT

An apparatus for continuously producing a tube having helical grooves in its inner surface comprising a tube twising rotary frame, a pay-off drum mounted on the rotary frame for paying off a tube having straight grooves in its inner surface, a nozzle provided at the front end of the rotary frame and having an adjustable inside diameter for sending out the paid-off tube forwardly of the rotary frame, and at least one pair of catching rollers provided in front of the rotary frame and disposed close to the nozzle for holding the sent-out tube. Each of the catching rollers is formed in its peripheral surface with a groove of semicircular cross section in conformity with approximately one-half of the outer periphery of the tube. With the rotation of the rotary frame, the straight-grooved tube is twisted between the nozzle and the catching rollers, whereby the straight grooves are deformed to helical grooves.

5 Claims, 4 Drawing Sheets

APPARATUS FOR CONTINUOUSLY PRODUCING TUBE HAVING HELICAL GROOVES IN ITS INNER SURFACE

BACKGROUND OF THE INVENTION

The present invention relates to an apparatus for continuously producing a tube having helical grooves in its inner surface and useful chiefly as a refrigerant tube for heat exchangers.

Tubes having helical grooves in the inner surface, when used as refrigerant tubes, assure heat exchange between the refrigerant passing through the tube and the outside air with a higher efficiency than is achieved by usual tubes, so that these grooved tubes are advantageous for producing heat exchangers of reduced size with reduced quantities of materials. An apparatus for producing such a tube internally having helical grooves has already been disclosed in Unexamined Japanese patent Publication No. 167029/73. This conventional apparatus comprises a tube twisting rotary frame, a pay-off drum mounted on the rotary frame for paying off a tube having straight grooves in its inner surface, a pair of catching rollers provided at the front end of the rotary frame for holding the paid-off tube, a pair of rollers arranged in front of the catching rollers for preventing cross sectional deformation of the tube, tubular means disposed in front of the deformation preventing rollers for correcting the cross section of the tube, and a capstan composed of front and rear two winding drums for winding the tube thereon after the tube has passed between the opposed rollers of the pairs and through the tubular means. The straight-grooved tube is twisted between the front winding drum and the catching rollers by the rotation of the rotary frame, whereby the straight grooves are deformed to helical grooves.

The smaller the distance over which the tube is twisted, the better, since if the distance is large and if the tube wall is eccentric, the twisting force will act concentrically on the thin wall portion, possibly flattening the tube of circular cross section. This tendency becomes more pronounced when the twisting angle is greater. With the conventional apparatus, the tube is twisted between the front winding drum and the catching rollers, so that the distance over which the tube is twisted is great. While the front winding drum constitutes the capstan along with the rear winding drum, the capstan need not always comprise two winding drums but may comprise a single winding drum. Accordingly, it may be attempted to reduce the distance by eliminating the front winding drum and also eliminating the deformation preventing rollers in front of the catching rollers and the correcting means in front of the preventing rollers. However, the reduction in the tube twisting distance is limited since the winding drum is diametrically much larger than the catching rollers.

The conventional apparatus has another problem. The catching rollers are intended to prevent the twisting action on the tube from being transmitted toward the pay-off drum. Nevertheless, if the tube is nipped too strongly for this purpose, the tube will not be paid off smoothly, whereas if the tube is nipped too loosely to pay off the tube smoothly, the tube twisting force will be delivered toward the pay-off drum. Thus, it has been impossible for the catching rollers to prevent transmission of the tube twisting action toward the pay-off drum while assuring smooth paying-off of the tube.

SUMMARY OF THE INVENTION

The main object of the present invention is to overcome the foregoing problems and to provide an apparatus for continuously producing a tube which has helical grooves in its inner surface. The apparatus comprises a tube twisting rotary frame, a pay-off drum mounted on the rotary frame for paying off a tube having straight grooves in its inner surface, a nozzle provided at the front end of the rotary frame and having an adjustable inside diameter for sending out the paid-off tube forwardly of the rotary frame, and at least one pair of catching rollers provided in front of the rotary frame and disposed close to the nozzle for holding the sent-out tube, each of the catching rollers being formed with a groove of semicircular cross section in conformity with approximately one-half of the outer periphery of the tube, whereby the straight-grooved tube is twisted between the nozzle and the catching rollers by the rotation of the rotary frame to deform the straight grooves to helical grooves. The tube twisting distance in the apparatus of the present invention is much smaller than in the conventional apparatus. Accordingly, even if the tube to be treated has an eccentric wall, there is no likelihood that the twisting force will act concentrically on the thin wall portion to flatten or deform the tube. Consequently, the tube can be twisted a larger angle than conventionally.

By suitably adjusting the inside diameter of the nozzle, the tube can be sent out therefrom smoothly without permitting transmission of torsion of the tube toward the pay-off drum.

The groove of semicircular cross section corresponding to approximately one-half of the outer periphery of the tube is formed in the outer periphery of each catching roller, so that the pair of catching rollers holds the tube while permitting the tube to retain its circular form, effectively twisting the tube with the rotation of the rotary frame.

The present invention will be described in greater detail with reference to the accompanying drawings.

DESCRIPTION OF THE PREFERRED EMBODIMENT

Figure 1:
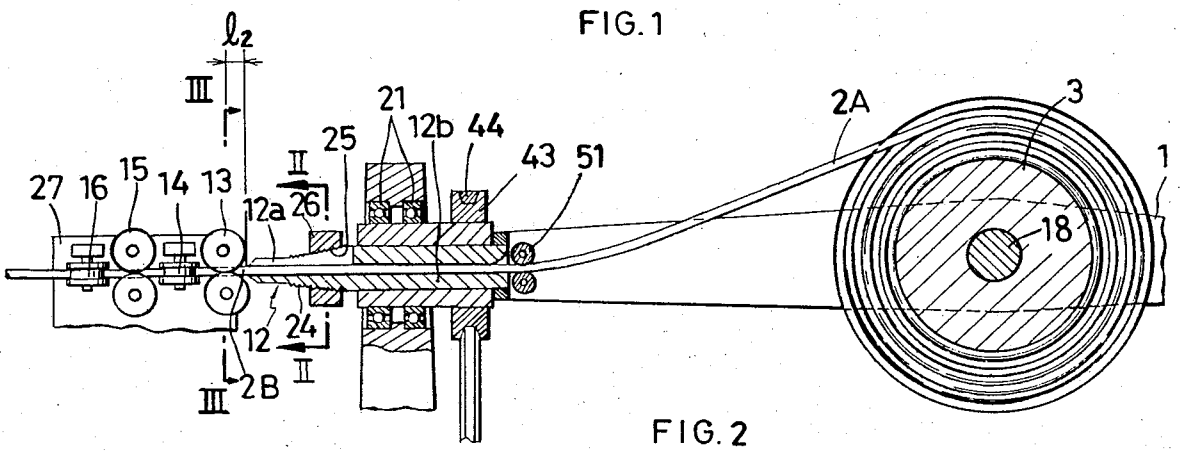
FIG. 1 is an enlarged fragmentary side elevation partly broken away and showing an apparatus embodying the invention for continuously producing a tube having helical grooves in its inner surface.
Figure 2:
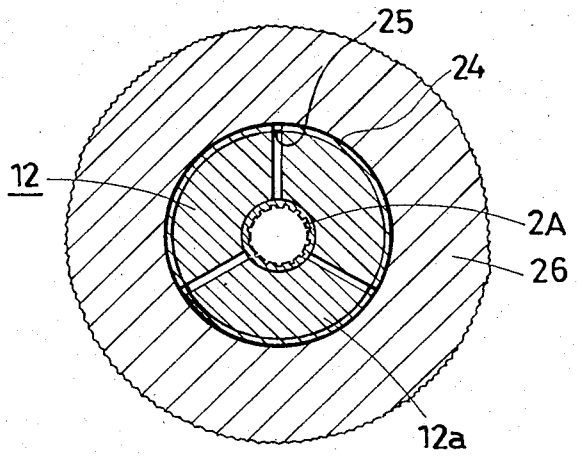
FIG. 2 is an enlarged view in section taken along the line II—II in FIG. 1.
Figure 3:
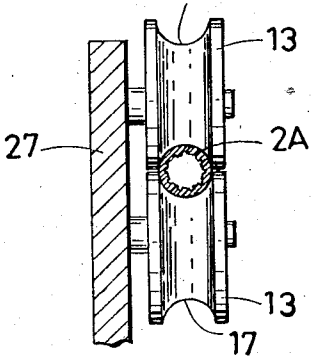
FIG. 3 is an enlarged view in section taken along the line III—III in FIG. 1.
Figure 4:
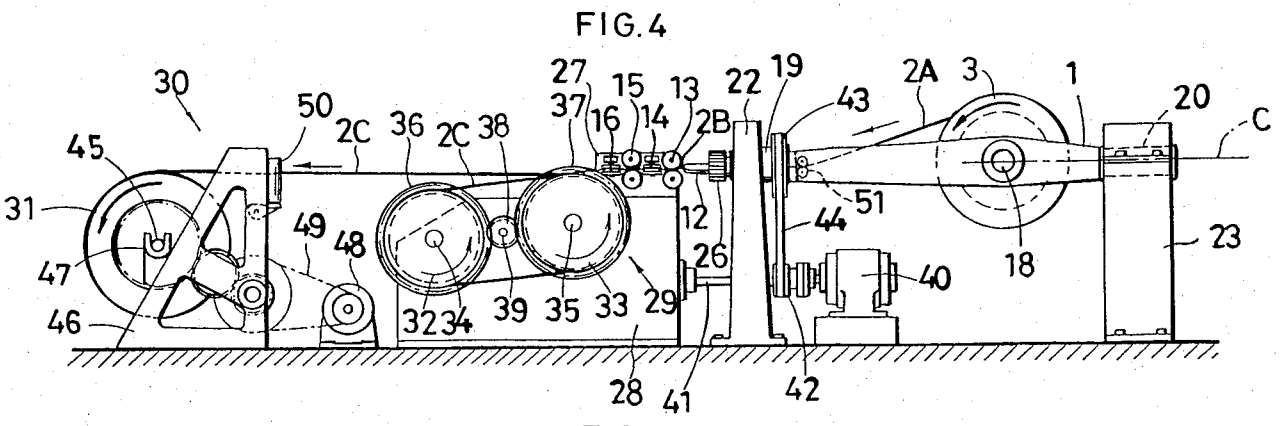
FIG. 4 is a side elevation showing the apparatus of FIG. 1 in its entirety.
Figure 5:
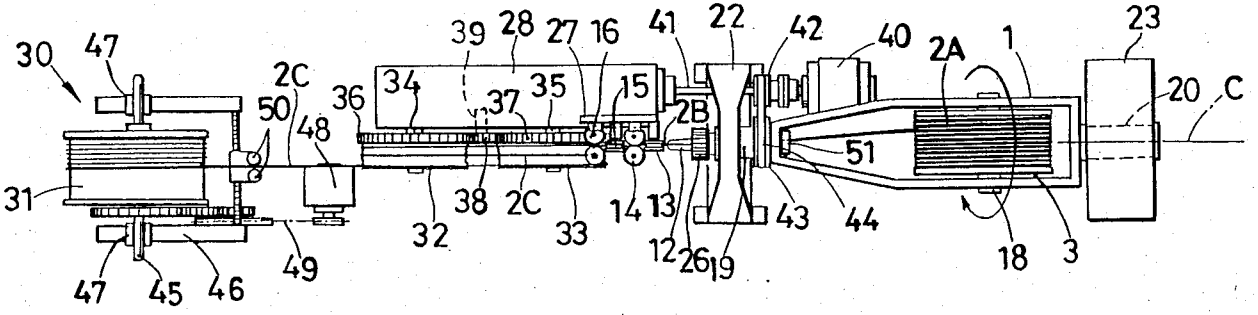
FIG. 5 is a plan view showing the apparatus of FIG. 1 in its entirety.

The term "front" or "forward" as used herein refers to the direction of feed of the tube, i.e. to the left-hand side of FIGS. 4 and 5.

Figure 6:
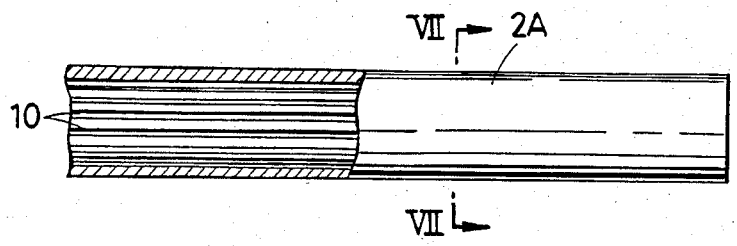
FIG. 6 is an enlarged fragmentary side elevation partly broken away and showing a tube having straight grooves in its inner surface.
Figure 7:
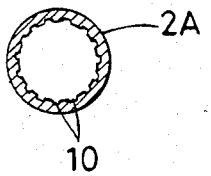
FIG. 7 is a view in section taken along the line VII—VII in FIG. 6.
Figure 8:
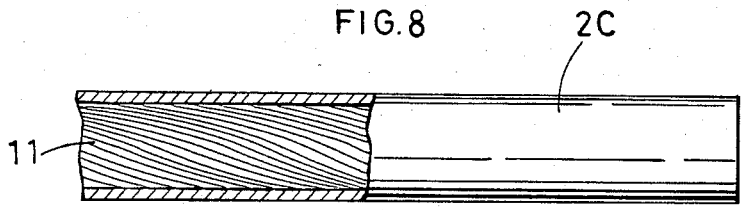
FIG. 8 is an enlarged fragmentary side elevation partly broken away and showing the helically grooved tube.

The apparatus of the present invention is adapted to continuously produce a tube 2C having a multiplicity of helical grooves 11 in its inner surface (see FIG. 8) from a tube 2A prepared by extrusion and having straight grooves 10 in its inner surface (see FIGS. 6 and 7). With reference to FIGS. 1 to 5, the apparatus comprises a tube twisting rotary frame 1, a pay-off drum 3 mounted on the rotary frame 1 for paying off the straight-grooved tube 2A, a nozzle 12 provided at the front end of the rotary frame 1 and having an adjustable inside diameter for sending out the paid-off tube 2A forwardly of the rotary frame 1, and first to fourth pairs of catching rollers 13 to 16 provided in front of the rotary frame 1 and disposed close to the nozzle 12 for holding the sent-out tube 2B. Each of the catching rollers 13 to 16 is formed in its peripheral surface with a groove 17 of semicircular cross section corresponding to approximately one-half of the outer periphery of the tube 2B. With the rotation of the rotary frame 1, the straight-grooved tube 2A is twisted between the nozzle 12 and the first catching rollers 13, whereby the straight grooves 10 are deformed to helical grooves 11.

A shaft 18 intersecting the axis C of rotation of the rotary frame 1 supports the pay-off drum 3 on the frame 1. The rotary frame 1 is provided with tubular projecting shafts 19, 20 at its front and rear ends, respectively. The shafts 19, 20 are mounted respectively on stands 22, 23 housing bearings 21. The nozzle 12 comprises an adjustable portion **12*a* having an externally threaded tapered portion 24 and three splitting grooves extending from its front end so as to be reducible in its inside diameter, and a fixed portion 12*b* fixedly fitted in the front tubular projecting shaft 19. A nut 26 having an internally threaded tapered portion 25 in conformity with the externally threaded tapered portion 24 is screwed on the portion 24. Guide rollers 51 positioned immediately in the rear of the fixed nozzle portion 12*b* are mounted on the rotary frame 1 for guiding the straight-grooved tube 2A, paid off from the drum 3, into the nozzle 12**.

The first and third catching rollers 13, 15 are mounted on a vertical plate 27 with their shafts positioned horizontally, and the second and fourth catching rollers 14, 16 are also mounted on the vertical plate 27 with their shafts positioned vertically. The vertical plate 27 is secured in an upright position to the upper surface of a rear portion of a hollow gear box 28 which is disposed in front of the front stand 22 toward one side thereof.

The distance $l_2$ between the center of each first catching roller 13 and the front end of the nozzle 12 is much smaller than the distance $l_1$ between the center of a front take-up drum of the conventional apparatus of FIG. 9 and the center of each catching roller thereof as will be described later. Upon passing through the space between the first catching rollers 13, the tube 2B twisted between the rollers 13 and the nozzle 12 is in the form of a tube 2C having helical grooves 11 completely so deformed from the straight grooves 10. If the twist involves distortion, the distortion is remedied while the tube 2C is passing between the opposed catching rollers of the second to fourth pairs 14 to 16. The tube 2C is passed around a capstan 29 in front of these rollers and wound on a take-up drum 31 of a winch 30. Preferably, the distance $l_2$ between the first catching rollers 13 and the nozzle 12 should be reduced to the greatest possible extent.

The capstan 29 has front and rear two winding drums 32, 33 which are attached to one side of the hollow gear box 28 by horizontal shafts 34, 35, respectively. These drums 32 and 33 are formed with a plurality of helical grooves so that the tube 2C will pass around the drums correctly. The front drum 32 is positioned at a slightly lower level than the rear drum 33 and spaced therefrom by a small distance. Between the gear box 28 and the winding drums 32, 33, large gears 36, 37 are fixedly mounted on the horizontal shafts 34, 35, respectively. A pinion 38 meshing with the two gears 36, 37 is provided therebetween and mounted on a horizontal shaft 39 extending into the gear box 28. An electric motor 40 provided in the rear of the front stand 22 for driving the rotary frame 1 and the capstan 29 has an output shaft 41 extending through the front stand 22 into the gear box 28. The output shaft 41 is coupled to the horizontal shaft 39, for example, by bevel gears for the transmission of torque. Pulleys 42, 43 are fixedly mounted on the base portion of the output shaft 41 and the front projecting shaft 19 of the rotary frame 1, respectively, with a belt 44 reeved around the pulleys 42, 43. Thus, the torque of the motor 40 is dividedly transmitted to the capstan 29 and to the rotary frame 1.

The take-up drum 31 of the winch 30 has a shaft 45 which is supported by bearings 47 on a stand 46. An electric motor 48 for driving the take-up drum 31 is disposed to the rear of the stand 46. The torque of the motor 48 is delivered to the drum shaft 45 via a transmission 49. A pair of horizontally movable guide rollers 50 is mounted on the rear side of the stand 46 for nipping the tube 2C from opposite sides and guiding the tube onto the drum 31 so that the tube can be wound helically around the drum closely from its one end toward the other end.

Figure 9:
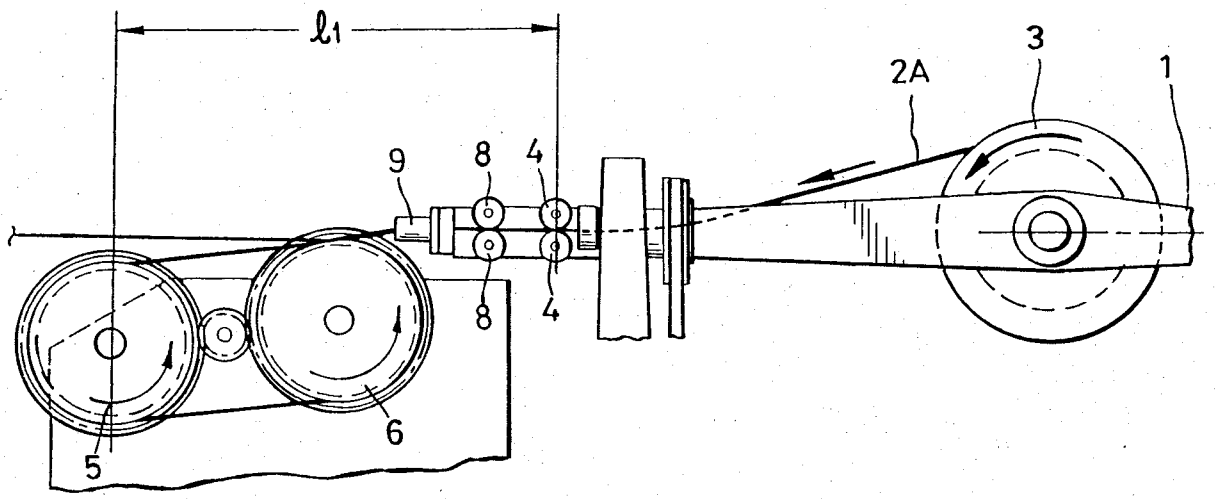
FIG. 9 PRIOR ART
FIG. 9 is an enlarged fragmentary side elevation showing a conventional apparatus.

FIG. 9 shows the conventional apparatus to be compared with the present apparatus. This conventional apparatus comprises a tube twisting rotary frame 1, a pay-off drum 3 mounted on the rotary frame 1 for paying off a tube 2A having straight grooves in its inner surface, a pair of catching rollers 4 provided at the front end of the rotary frame 1 for holding the paid-off tube, a pair of rollers 8 arranged in front of the catching rollers 4 for preventing cross sectional deformation of the tube, tubular means 9 disposed in front of the deformation preventing rollers 8 for correcting the cross section of the tube, and a capstan composed of front and rear two winding drums 5, 6 for winding the tube thereon after the tube has passed between the opposed rollers 4, 8 of the pairs and through the correcting means 9.

With this conventional apparatus, the tube is twisted between the front winding drum 5 and the catching rollers 4, so that the center-to-center distance $l_1$ for twisting the tube is large.

The tube to be wound around the pay-off drum of the present apparatus is an aluminum extrudate having a multiplicity of straight grooves formed in its inner surface by extrusion. However, the material is not limited to aluminum but can be copper, soft steel or the like. Further the tube is not limited to one having straight grooves in its inner surface only as seen in FIGS. 6 and 7; an aluminum extrudate having straight grooves in both the inner and outer surfaces can be made into a tube having helical grooves in its inner and outer surfaces.

The groove twisting angle is dependent on the speed of rotation of the rotary frame and the speed of rotation of the capstan. For example, when the former speed is constant, an increase in the latter speed results in a smaller twisting angle. Accordingly, a transmission is selected which gives the desired twisting angle.

Although the nozzle of the foregoing embodiment has three splitting grooves, the number of grooves is not limitative but can be two or at least four. The inside diameter of the nozzle is adjustable with the internally tapered threaded nut screwed on the externally threaded tapered portion of the nozzle by advancing or retracting the nut. Alternatively, the adjustment may be made by causing a hydraulic cylinder to act on each split portion of the nozzle perpendicular thereto and controlling the hydraulic pressure, or by adjusting the force of a pushing spring disposed perpendicular to each split nozzle portion.

In the foregoing embodiment, a plurality of pairs of catching rollers are arranged, and the adjacent pairs of rollers differ from each other by 90 degrees in the orientation of their shafts. This arrangement is desirable since the catching rollers for holding the tube also act to remedy deformation of the tube. However, the tube can be twisted satisfactorily by one pair of catching rollers. In this case, the second to fourth catching rollers may be replaced by other correcting means.

What is claimed is:

1. An apparatus for continuously producing a tube having helical grooves in its inner surface comprising a tube twising rotary frame, a pay-off drum mounted on the rotary frame for paying off a tube having straight grooves in its inner surface, a nozzle provided at the front end of the rotary frame and having an adjustable inside diameter for sending out the paid-off tube fowardly of the rotary frame, and at least one pair of catching rollers provided in front of the rotary frame and disposed close to the nozzle for holding the sent-out tube, each of the catching rollers being formed with a groove of semicircular cross section in conformity with approximately one-half of the outer periphery of the tube.

2. An apparatus as defined in claim 1 wherein the nozzle comprises an adjustable portion having an externally threaded tapered portion and a plurality of splitting grooves extending from its front end so as to be reducible in its inside diameter, and a fixed portion secured to the front end of the rotary frame, a nut having an internally threaded tapered portion in conformity with the externally threaded tapered portion and being screwed on the externally threaded tapered portion.

3. An apparatus as defined in claim 1 wherein the nozzle comprises an adjustable portion having an externally threaded tapered portion and three splitting grooves extending from its front end so as to be reducible in its inside diameter, and a fixed portion fixedly fitted in a projecting tubular shaft provided at the front end of the rotary frame and rotatably mounted on a front stand, the front stand having a bearing housed therein, a nut having an internally threaded tapered portion in conformity with the externally threaded tapered portion and being screwed on the externally threaded tapered portion.

4. An apparatus as defined in claim 1 which comprises a plurality of pairs of catching rollers, and the adjacent pairs of catching rollers differ from each other by 90 degrees in the orientation of their shafts.

5. An apparatus as defined in claim 1 which comprises four pairs of catching rollers, and the pairs of catching rollers each having a horizontal shaft and the pairs of catching rollers each having a vertical shaft are arranged alternately.

* * * * *